US006123405A

United States Patent [19]

Temple et al.

[11] Patent Number: 6,123,405

[45] Date of Patent: Sep. 26, 2000

[54] METHOD OF OPERATING A MULTI-CHANNEL PRINTHEAD USING NEGATIVE AND POSITIVE PRESSURE WAVE REFLECTION COEFFICIENT AND A DRIVING CIRCUIT THEREFOR

[75] Inventors: Stephen Temple, Cambridge; Michael George Arnott, Somersham, both of United Kingdom

[73] Assignee: Xaar Technology Limited, Cambridge, United Kingdom

[21] Appl. No.: 08/699,798

[22] Filed: Aug. 19, 1996

Related U.S. Application Data

[63] Continuation of application No. PCT/GB95/00562, Mar. 16, 1995.

[30] Foreign Application Priority Data

Mar. 16, 1994 [GB] United Kingdom ..... 9405137

[51] Int. Cl.[7] ..... B41J 29/38

[52] U.S. Cl. ..... 347/10; 347/11

[58] Field of Search ..... 347/10, 11, 68–72, 347/94

[56] References Cited

U.S. PATENT DOCUMENTS

| | | | |
|---|---|---|---|
| 4,161,670 | 7/1979 | Kern | 310/317 |
| 4,716,418 | 12/1987 | Heinzl et al. | 347/11 |
| 4,743,924 | 5/1988 | Scardovi | 347/10 |
| 4,752,790 | 6/1988 | Scardovi | 347/10 |
| 4,879,568 | 11/1989 | Bartky et al. | 347/69 |
| 4,887,100 | 12/1989 | Michaelis et al. | 347/69 |
| 4,897,665 | 1/1990 | Aoki | 347/10 |
| 4,972,211 | 11/1990 | Aoki | 347/11 |
| 5,016,028 | 5/1991 | Temple | 347/69 |
| 5,594,476 | 1/1997 | Tokunaga et al. | 347/10 |
| 5,764,247 | 6/1998 | Asai | 347/10 |
| 5,764,256 | 6/1998 | Zhang | 347/10 X |

FOREIGN PATENT DOCUMENTS

| | | |
|---|---|---|
| 0 375 147 | 6/1990 | European Pat. Off. . |
| 376532 | 7/1990 | European Pat. Off. . |
| 59-104950 | 6/1984 | Japan . |
| 59-176060 | 10/1984 | Japan . |
| 2-506 | 1/1990 | Japan . |
| 3-147022 | 12/1992 | Japan . |

*Primary Examiner*—John Barlow
*Assistant Examiner*—C. Dickens
*Attorney, Agent, or Firm*—Marshall, O'Toole, Gerstein, Murray & Borun

[57] ABSTRACT

The selected ink channels of a drop-on-demand ink jet printer are caused to expand and then contract, ejecting ink droplets by the application of unipolar voltages first to selected channels and then to non-selected channels. Further unipolar voltages, delayed in time by 2L/c and scaled by a pressure wave reflection coefficient r of the nozzle, effect prompt cancellation of residual pressure waves so that adjacent channels are ready for actuation with minimum delay.

13 Claims, 12 Drawing Sheets

PRESSURE WAVES IN CHANNEL a
PRESSURE WAVES IN CHANNEL b
PRESSURE WAVES IN CHANNEL c
RIGHT-GOING PRESSURE WAVES INCIDENT AT THE NOZZLE
2
1
0
-1
5
10
15
L/C
FIRE GROUP a
FIRE GROUP b
FIRE GROUP c

ACTUATION VOLTAGE WAVEFORM OF PERIOD 4 L/C
FIRING VOLTAGE WAVEFORMS
3
2
1
0
1
2
3
4
5
6
7
8
L/C
FIRING LINE
NON FIRING LINE

FIRING LINE
NON FIRING LINE ADJACENT TO FIRED LINE
RIGHT-GOING PRESSURE WAVES INCIDENT IN THE NOZZLE
3
2
1
0
-1
-2
-3
4 L/C
4 L/C

METHOD OF OPERATING A MULTI-CHANNEL PRINTHEAD USING NEGATIVE AND POSITIVE PRESSURE WAVE REFLECTION COEFFICIENT AND A DRIVING CIRCUIT THEREFOR

CROSS REFERENCE TO RELATED APPLICATION

This is a continuation of International Application No. PCT/GB95/00562 filed Mar. 16, 1995, the disclosure of which is incorporated herein by reference.

BACKGROUND OF THE INVENTION

The present invention relates to pulsed droplet deposition apparatus, for example drop-on-demand-ink jet printing apparatus and, in the most important example, provides voltage waveforms for the control of such apparatus.

Ink jet printing apparatus having a multiplicity of closely spaced parallel ink channels and channel separating piezoelectrically displaceable wall actuators have been disclosed for example in U.S. Pat. No. 4,879,568 (EP-B-0277703) and in U.S. Pat. No. 4,887,100 (EP-B-0278590). In such apparatus each channel is actuable by one or both of the displaceable side-walls. In a typical arrangement an external connection is provided which relates to each channel and when a voltage difference is applied between the electrode corresponding to one channel and the electrodes of the neighbouring channels, the walls adjacent to the channel are displaced causing the volume of the centre channel, depending on the voltage sign, to expand or to contract and an ink drop to be ejected from the nozzle communicating with the channel.

One feature of the above printing apparatus having displaceable side-walls is that operation of every channel at the same time is excluded. Operation takes place by dividing the printhead into two groups of odd and even channels, which are operated alternately. Alternatively the printhead is divided into groups of three, four or more channels which are operated in rotation (EP-A-0376532).

One waveform commonly used in the prior art is described in U.S. Pat. No. 4,161,670 in relation to the actuation of tubular ink jet actuating elements. In this case the applied voltage acts first to expand the diameter of the tubular drive element which contains ink, maintaining the expanded state for a period to admit ink into the ink tube, and then applying a voltage of reverse polarity to change the diameter of the tubular drive element from an expanded to a contracted state to eject an ink drop.

Such a waveform is implemented in the prior art by an oscillatory circuit, or if a pulsed waveform generator is employed pulses of both positive and negative polarity are required to generate it. Under conditions where drop-on-demand printheads are a mass produced component, the drive circuit necessarily takes the form of an integrated circuit chip, and such devices have the disadvantage of being considerably more expensive if required to handle bipolar signals.

Another disadvantage of the above waveform is that following drop ejection, there remains in the tubular actuator residual acoustic waves, and it is necessary to wait until these acoustic waves are damped before a further drop is ejected. This problem has been recognised in U.S. Pat. No. 4,743,924 and in U.S. Pat. No. 4,752,790 and in the former case it is proposed to provide an additional pulse to suppress acoustic reflection waves of the expulsion pressure wave at a time four periods L/c following the pressure wave (i.e. two characteristic times Tc).

SUMMARY OF THE INVENTION

The present invention seeks to reduce or eliminate one or both of the foregoing disadvantages.

Accordingly, the present invention consists in one aspect in a method of operating multichannel pulsed droplet deposition apparatus having droplet liquid channels each with a nozzle having a negative pressure wave reflection coefficient r, the method comprising ejecting a droplet from a selected channel by generating a defined pressure pulse therein and substantially cancelling residual pressure waves in said channel by generating a further pressure pulse after a delay of 2L/c where L is the length of the channel and c is the effective velocity of pressure waves therein.

Advantageously, the amplitude of said further pressure pulse being related to the amplitude of said defined pressure pulse by the factor r.

Suitably, the method comprises ejecting a droplet from a selected channel by generating a negative pressure pulse of duration L/c followed by a positive pressure pulse of duration at least L/c with the duration of said positive pressure pulse preferably being 2L/c.

In one form of the invention, the selected channel is bounded by a displaceable wall actuator, displacement of which generates said first and further pressure pulses, said actuator also bounding an adjacent non-selected channel, the selected and non-selected channels being in respective groups of channels which are actuated sequentially, the displacement of the actuator also generating a complementary first pressure pulse in the adjacent channel and a complementary further pulse in said adjacent channel which cancels residual pressure waves therein arising from the complementary first pressure pulse.

According to a further aspect, the present invention consists in a method of operating multichannel pulsed droplet deposition apparatus having droplet liquid channels separated by wall actuators displaceable on the application thereto of a voltage difference, each channel having electrode means associated with the wall actuators bounding that channel such that a voltage difference can be applied to a specified wall actuator by the application of different voltages to the respective electrode means of the two channels separated by the said wall actuator, the method comprising the actuation of a selected channel through the steps of applying in different time periods a first actuating voltage to the electrode means of the selected channel and a second actuating voltage of the same polarity to the electrode means of non-selected channels, thereby to cause an expansion and contraction of the droplet liquid volume of the selected channel to effect ejection of a droplet therefrom.

Advantageously, the channels are divided into at least two groups, the groups being sequentially enabled for actuation, adjacent channels being in different groups.

Preferably, said voltages are applied in time periods spaced by the interval L/c or multiples thereof, where L is the length of the channel and c is the effective velocity of pressure waves therein and, suitably, the first voltage is applied for a first time period L/c and the second voltage is applied for the immediately following second time period L/c.

According to still a further aspect, the present ivention consists in a method of operating multichannel pulsed droplet deposition apparatus having droplet liquid channels, the channels being divided into at least two groups, the groups being sequentially enabled for actuation, adjacent channels being in different groups, comprising the steps of actuating selected channels by the application thereto of an actuating pressure variation to effect droplet ejection therefrom, and ensure no pressure wave contribution to the droplet liquid in the channels of sequentially enabled groups of channels by the application of a correcting pressure variation.

Preferably, the correcting pressure variation is delayed in time with respect to the actuating pressure variation by the interval 2L/c.

According to still a further aspect, the present invention consists in a method of operating multichannel pulsed droplet deposition apparatus having droplet liquid channels of length L, having an effective velocity c of pressure waves therein, with a droplet ejection nozzle having a pressure wave reflection coefficient r, comprising the steps of actuating selected channels by the application thereto of an actuating pressure variation to effect droplet ejection therefrom, and cancelling residual waves by the application of a correcting pressure variation delayed in time by the interval 2L/c, wherein the correcting pressure variation varies in time in the same manner as the actuating pressure variation and is related in amplitude to the actuating pressure variation by a factor less than 1.

Advantageously, wherein the said pressure variations are applied through voltage signals of step waveform having four or five steps each of duration L/c.

According to still a further aspect, the present invention consists in a method of operating multichannel pulsed droplet deposition apparatus having droplet liquid channels separated by wall actuators displaceable on the application thereto of a voltage difference, each channel having electrode means associated with the wall actuators bounding that channel such that a voltage difference can be applied to a specified wall actuator by the application of different voltages to the respective electrode means of the two channels separated by the said wall actuator, the method comprising the actuation of a selected channel through the steps of applying an actuating voltage to the electrode means of the selected channel thereby to effect ejection of a droplet therefrom and the at least partial cancellation of residual pressure waves by applying a correcting voltage of the same polarity to the electrode means of non-selected channels.

In still a further aspect, the present invention consists in a driving circuit for a multi-channel pulsed droplet deposition apparatus having droplet liquid channels separated by wall actuators displaceable on the applicator thereto of a voltage difference, each channel having electrode means associated with the wall actuators bounding that channel such that a voltage difference can be applied to a specified wall actuator by the application of different voltages to the respective electrode means of the two channels separated by the said wall actuator, the driving circuit having terminals for respective connection with said electrode means and being adapted for actuation of a selected channel through the steps of applying in different time periods a first actuating voltage to the electrode means of the selected channel and a second actuating voltage of the same polarity to the electrode means of non-selected channels, thereby to cause an expansion and contraction of the droplet liquid volume of the selected channel to effect ejection of a droplet therefrom.

Thus, in the present invention waveforms are suitable for the operation of multi-channel ink jet printheads having channel dividing wall actuators in which the channels are operated in groups. The waveforms are arranged for application by a unipolar drive circuit, but maintain the advantages of driving the ink channels to eject drops by causing both expansion and contraction of ink channels during operation. The waveforms incorporate reflection suppressing pulses which are applied in the printhead after a period of 2 L/c following the application of the drop ejecting pulse.

One particular advantage of the waveforms in the type of printhead referred to is that suppression of the reflected pressure waves occurs in the neighbouring channels as opposed to the channels from which a drop has just been ejected. Since in a printhead in which channels are divided into groups actuated in rotation, it is the neighbouring channel that is next operated, this enables actuation to continue, by applying a waveform for drop ejection to the next channel without delay as soon as the waveform from a first channel is complete. Another advantage is that the pressure generated in each channel for drop ejection is as much as three times the pressure that is generated by a simple unipolar pulse and that the drop ejection waveform for drop ejection including reflection wave suppression is completed within five or in one case within four channel acoustic periods 2 L/c.

In one particular embodiment the waveform applied to the wall actuators comprises step voltage changes at periodic intervals L/c of the channel. In one aspect the waveform is completed after five intervals L/c: in another embodiment the waveform is completed after four intervals. A portion of the waveform in selected periodic intervals may be applied to the wall actuators adjacent to channels not selected for firing and the remaining portion may be applied to the wall actuators adjacent to channels selected for actuation in accordance with print data provided to the group designated for printing.

The waveform applied to the wall actuators, in causing the walls both to expand and correct the volume of said selected channels, generates both positive and negative acoustic pressure waves. The positive wave in the second period may be selected in magnitude to control the ejection velocity of the drop. The negative pressure wave in the third period may be selected in magnitude to control drop break-off.

In the aforesaid further aspect of the invention voltage waveform is selected in the last two periods thereof to suppress residual acoustic pressure waves in the head, by generating voltage magnitudes which generate pressure waves to substantially cancel the residual acoustic energy after drop ejection in the said selected channel. Preferably the voltage magnitudes are selected in relation to the nozzle reflection coefficient (r). In one form the voltage magnitudes for cancellation are applied two acoustic periods L/c (ie. one characteristic time Tc) after the period of generation of acoustic pressure waves generated to effect drop ejection or drop break-up.

The voltage waveform may be selected to suppress residual acoustic waves in neighbouring channels adjacent the channel selected for drop ejection.

BRIEF DESCRIPTION OF THE DRAWINGS

The invention will now be described by way of example by reference to the following diagrams in which:

FIG. 5(*b*) illustrates the corresponding pressure magnitudes in the actuated channel and in a neighbouring channel;

FIG. 5(*c*) illustrates how the voltage pattern of FIG. 5(*a*) can be resolved into an actuating voltage pattern (shown in full line) which generates pressure waves in the channel to eject a drop and a correcting voltage pattern (shown in dotted line) which cancels the residual pressure waves in the channel;

FIG. 6(*b*) shows the corresponding right going pressure waves (the being adopted in this description that a right going pressure is incident in the nozzle) in the fired channels and in channels which are adjacent to the fired channels. The pressures in non fired channels and channels adjacent to them are negligible and are not shown;

FIG. 7(*b*) shows the corresponding right going pressure waves in fired and in adjacent non-fired lines;

FIG. 7(*c*) shows the difference voltage arising across a wall as a result of the application to the lines on either side of the waveforms shown in FIG. 7(*a*), resolved into an actuating voltage pattern (shown in full line) which generates pressure waves in the channel to eject a drop and a correcting voltage pattern (shown in coated line) which cancels the residual pressure waves in the channel;

FIG. 8(*b*) shows the corresponding right going pressure waves in the fired and the adjacent non-fired lines;

DETAILED DESCRIPTION OF THE INVENTION

Figure 1:
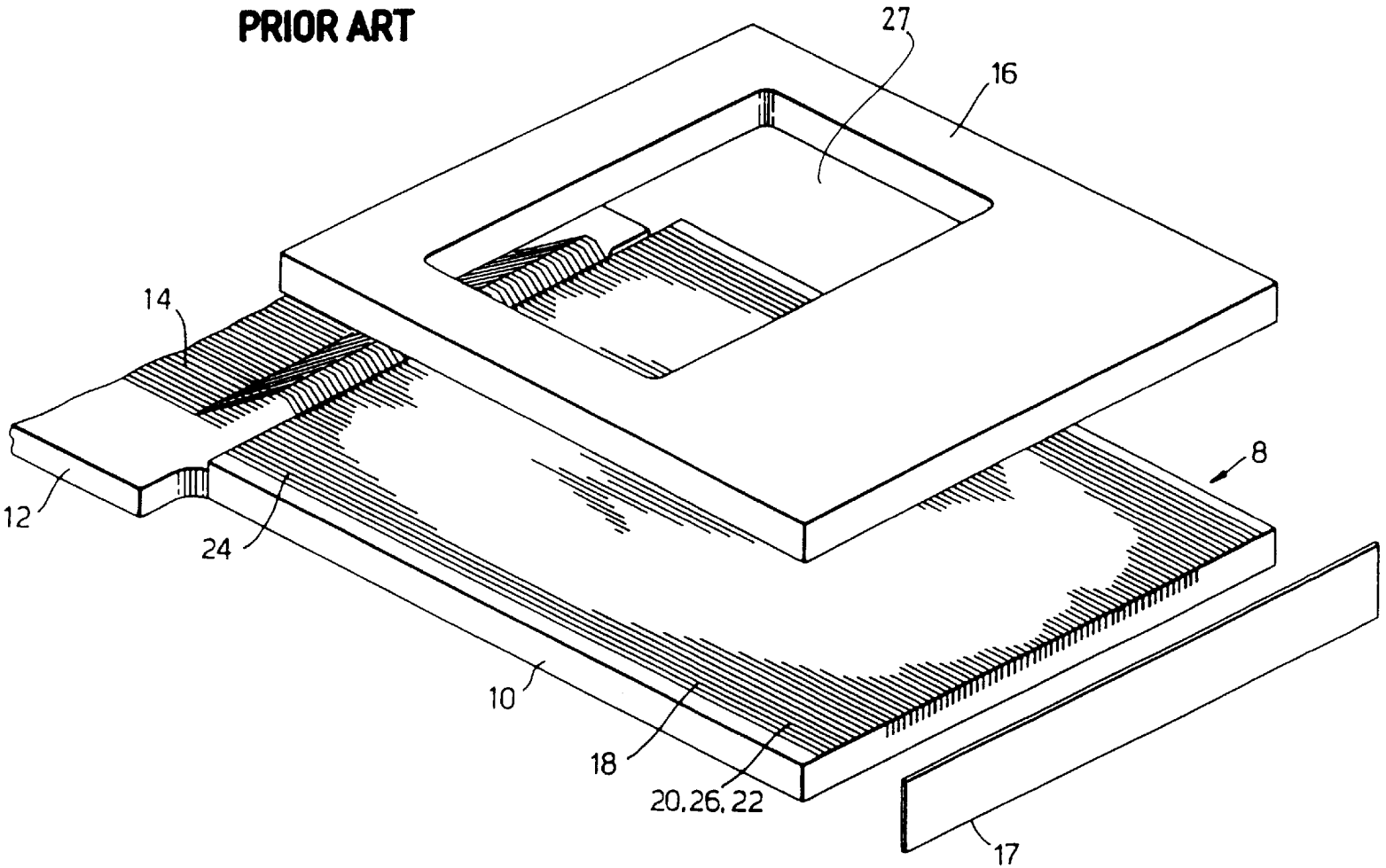
FIG. 1 PRIOR ART
FIG. 1 illustrates an exploded view in perspective of one form of ink jet printhead incorporating piezo-electric wall actuators operating in shear mode and comprising a printhead base, a cover and a nozzle plate.

FIG. 1 shows an exploded view in perspective of a typical ink jet printhead 8 incorporating piezo-electric wall actuators operating in shear mode. It comprises a base 10 of piezo electric material mounted on a circuit board 12 of which only a section showing connection tracks 14 is illustrated. A cover 16, which is bonded during assembly to the base 10 is shown above its assembled location. A nozzle plate 17 is also shown adjacent the printhead base.

A multiplicity of parallel grooves 18 are formed in the base 10 extending into the layer of piezo-electric material. The grooves are formed for example as described in U.S. Pat. No. 5,016,028 (EP-A-364136) and comprise a forward part in which the grooves are comparatively deep to provide ink channels 20 separated by opposing actuator walls 22. The grooves in the rearward part are comparatively shallow to provide locations for connection tracks. After forming the grooves 18, metallized plating is deposited in the forward part providing electrodes 26 on the opposing faces of the ink channels 20 where it extends approximately one half of the channel height from the tops of the walls and in the rearward par, is deposited providing connection tracks 24 connected to the electrodes in each channel 20. The tops of the walls are kept free of plating metal so that the track 24 and the electrodes 26 form isolated actuating electrodes for each channel.

After the deposition of metallized plating and coating of the base 10 with a passivant layer for electrical isolation of the electrode parts from the ink, the base 10 is mounted as shown in FIG. 1 on the circuit board 12 and bonded wire connections are made connecting the connection tracks 24 on the base part 10 to the connection tracks 14 on the circuit board 12.

Figure 2:
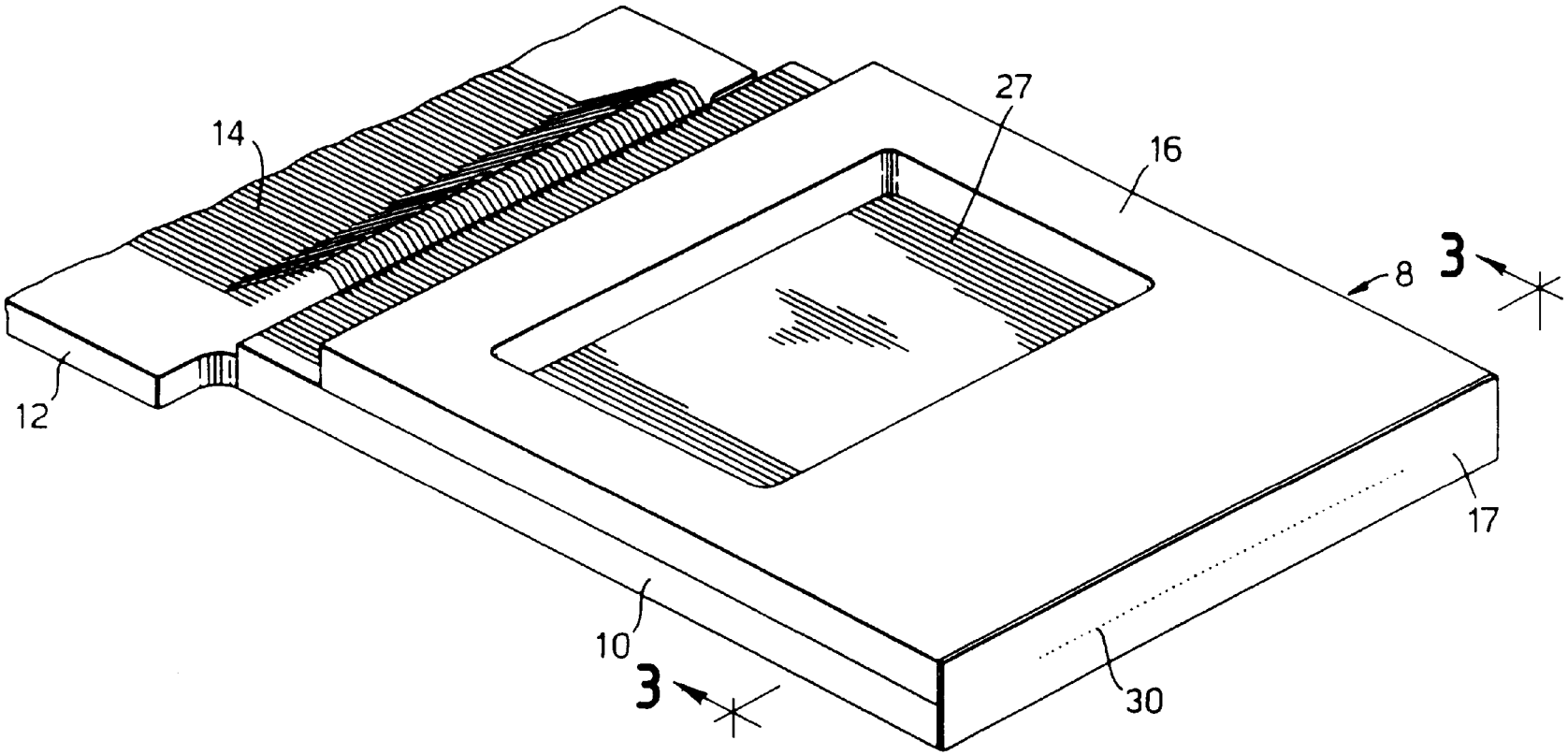
FIG. 2 PRIOR ART
FIG. 2 illustrates the printhead of FIG. 1 in perspective after assembly.
Figure 3:
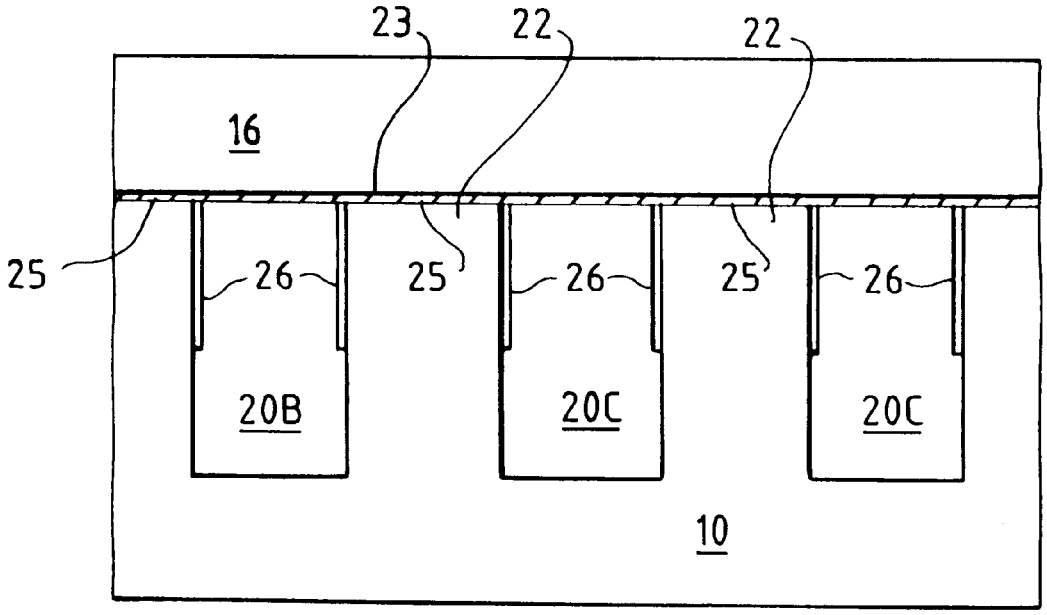
FIG. 3 PRIOR ART
FIG. 3 is a cross-sectional view of the assembled printhead of FIG. 2, taken along line 3—3 of FIG. 2, illustrating a typical selected channel and two adjacent non-selected channels.

The ink jet printhead 8 is illustrated after assembly in FIGS. 2 and 3. In the assembled printhead, the cover 16 is secured by bonding with an adhesive 25 to the tops of the actuator walls 22 thereby forming a multiplicity of closed channels 20 having access at one end to the window 27 in the cover 16 for the supply of replenishment ink. The nozzle plate 17 is attached by bonding at the other end of the ink channels. The nozzles 30 are shown in locations in the nozzle plate communicating to each channel formed by UV excimer laser ablation.

Figure 4:
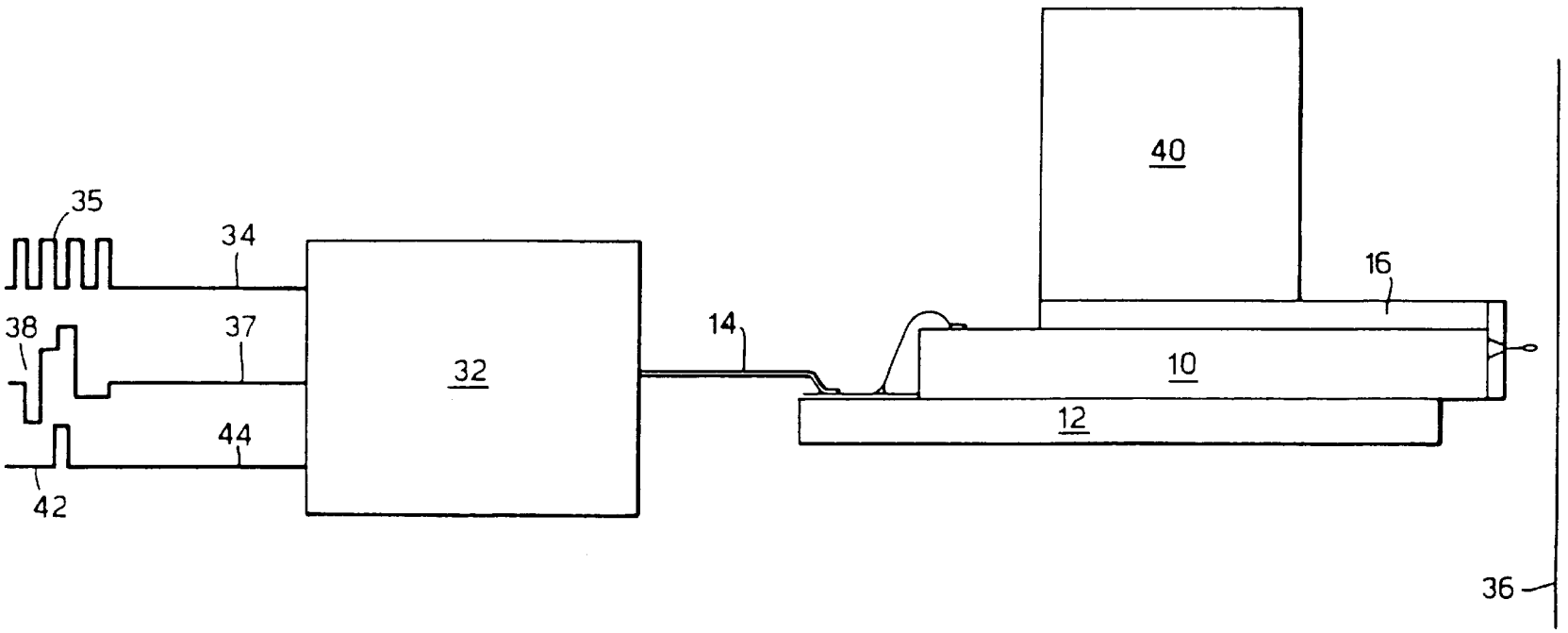
FIG. 4 PRIOR ART
FIG. 4 illustrates a drive circuit connected via connection tracks to the printhead to which are applied a drive voltage waveform, timing signals and print data for the selection of ink channels, so that on application of the waveform, drops are ejected from the channels selected.

The printhead is operated by delivering ink from an ink cartridge via the ink manifold 28, from where it is drawn into the ink channels to the nozzles 30 by capillary suction. The drive circuit 32 connected to the printhead is illustrated in FIG. 4. In one form it is an external circuit connected to the connection tracks 14, but in an alternate form (not shown) an integrated circuit chip may be mounted on the printhead. The drive circuit 32 is operated by applying by a data link 34 the print data 35 defining print locations in each print line as the printhead is scanned over a print surface 36 and at the same time applying an actuating voltage waveform 38 via the signal link 37.

On receipt of a clock pulse 42 via timing link 44 the voltage waveform 38 is applied selectively via the chip and the connection tracks 14 to selected ones of the electrodes 26 in each channels selected for operation to effect drop ejection therefrom. Examples of unipolar waveforms 38 (ie. waveforms having one polarity) employed in the invention are described below, in particular by reference to FIGS. 6, 7 and 8.

The present invention relates particularly to printheads of the type described in U.S. Pat. No. 4,879,568 (EP-B-0277703) and U.S. Pat. No. 4,887,100 (EP-B-0278590) and related patent specifications. That is to say printheads of the type in which ink channels are divided by laterally displaceable wall actuators and in which each ink channels is actuable by displacing the two wall actuators which bound it on either side.

One feature of these constructions is that the laterally displaceable wall actuators are actuated by the application of a voltage difference between electrodes located on or adjacent to the walls, so that there may in some constructions be two external electrodes per wall, requiring two external connections for actuation. However, it is usually convenient for connections to be made between the wall electrodes internally to provide one electrode per channel: when a voltage waveform is applied to the electrode corresponding to a channel and a datum voltage is applied to the electrodes of the neighbouring channel, the applied fields in the walls adjacent the channel then effect displacements of each wall causing the volume and pressure in the ink in each channel to be either increased or decreased. Regardless of whether the connections are made internally or externally of the printhead it is then convenient to describe the actuating signal as being applied in relation to a selected channel to effect drop ejection from that channel.

A second feature as indicated in the above patent specifications and related patent specifications (e.g. EP-A-0376532) is that only selected ink channels can be operated at one time and conveniently the channels may be operated in groups. For example, as indicated in U.S. Pat. No. 4,879,568 (EP-B-0277703) the printhead may be divided into two groups of odd and even channels which are actuated alternately. Or as indicated in EP-0376532 the channels may be divided into three or four or more groups actuated in rotation. In FIG. 3, a channel designated 20A is a typical selected channel and its two adjacent channels 20B and 20C are illustrative of non-selected channels.

Experiment has shown that the frequency at which drops may be ejected from one channel is determined by the replenishment time, that is the time following drop ejection that is required to restore the meniscus of ink in the nozzle. If a second waveform to effect drop ejection is applied to the channel following a first waveform before the ink meniscus has come to rest or is completely restored to the nozzle exit, so that replenishment of the channel following the first waveform is incomplete, then the drop generated via the second waveform is found to nave a different volume and different velocity from the first drop.

The operation of printers having displaceable wall actuators by dividing the channels into groups actuated in rotation at first sight might appear to be at a disadvantage. Because the speed of operation is reduced by two, three or four or more times depending on the number of groups. However, since it is ink replenishment time in each channel that controls print rate, and there is usually time for drop ejection to take place before replenishment is complete in the first channel, this apparent disadvantage of operation in groups is found not to arise in practice: and therefore the advantages of printheads having displaceable wall actuators, which are high channel density, efficient and low voltage operation and low cost of manufacture are obtained with no serious cost in terms of performance or frequency of operation.

The present invention is described by reference to actuation of a printhead having displaceable wall actuators by applying voltage waveforms to the electrodes of channels divided into three groups. That is to say the printhead comprises ink channels divided into three groups a, b, and c. It is generally found with the waveforms described that after actuating selected channels of the group a, there is time to actuate channels with the same waveform from groups b and c before replenishment is complete in group a, when a further waveform may then be applied to a. However, it will be evident to the skilled man, that if a particular configuration has a longer or a snorter replenishment time, or on other grounds, it will be possible to apply a waveform of the type described herein to other than three groups by simple modification of the principles described below.

A typical ink channel 20 containing ink and terminated by a nozzle 30 has been recognised in the prior art (e.g. U.S. Pat. No. 4,743,924 or U.S. Pat. No. 4,752,790) as behaving as an acoustic wave guide in which longitudinal pressure waves are generated. The channel in the above cited art is characterised by an open end at the termination connected to the ink supply and by an acoustically closed end at the nozzle. A characteristic time which is the time taken by a wave to traverse to and fro along the channel is Tc=2 L/c where L is the channel length and c is the effective velocity of longitudinal pressure waves. In this art the pressure waves traverse the channel by 2 L and return to the starting point, but have inverted sign after the characteristic time Tc. According to that invention a cancelling wave is generated which suppresses or completely cancels the initial drop ejecting pressure pulse by applying a voltage waveform of the same form, but opposite in sign to the original drop ejecting waveform after a time equal to an even multiple of the characteristic time Tc (i.e. 2Tc, 4Tc, 6Tc etc. which, equals 4 L/c, 8 L/c, 12 L/c etc.). Such a voltage pulse Is referred to as reflection suppressing or self cancelling.

Current ink jet printheads typically print at the resolutions, delivering ink volumes and employing nozzle sizes of magnitudes approximately as follows:

| Resolution dpmm | Drop Volume pl | Nozzle size Diameter $\mu$m |
|---|---|---|
| 8 | 130 | 50 |
| 12 | 50 | 35 |
| 16 | 30 | 25 |

In printheads of the type referred to above, having displaceable wall actuators, which are characterised by closely spaced channels having a relatively small cross section, it has been discovered that the nozzle terminations for nozzles of the above dimensions and with typical inks are generally acoustically open terminations. Accordingly the acoustic wave guide, represented by each channel has a negative reflection coefficient at the nozzle end.

| Termination | Reflection coefficient |
|---|---|
| ink supply end | $R_M = -1$ |
| Nozzle end | $-0.2 < R_N < -0.7$ |

$R_N$ will vary depending upon the nozzle geometry and ink characteristics.

We have found in such printers that a unit pressure pulse in one period L/c followed by a pressure pulse of magnitude $-R_M R_N$ of the same duration applied after a delay of 2 L/c (i.e. after one internally reflected characteristic period Tc) is effective in the present type of printhead to cancel or suppress the acoustic waves. This snorter period for cancellation conveniently reduces the total period for the generation of a voltage waveform to effect drop ejection and then to suppress or cancel the residual pressure waves. In the above 2 L/c is the resonance period of a channel, and may include some allowance for the inertance of the channel terminations.

This effect is exhibited by applying a pressure pulse of unit value in one period L/c to a channel having reflection coefficients $R_M=-1$, $R_N=r$ at each end and subsequently applying a pressure pulse $-R_M R_N=R_N=r$ in the third period in which r is negative. Such a pressure wave is generated by applying a pulsed voltage waveform of magnitudes proportional to 1, 0, r, 0 in successive periods. This voltage waveform generates pressure pulses in response to step changes in the applied voltage. The resulting applied pressure changes are of magnitudes proportional to +1, −1, +r, −r in successive periods of time interval L/c.

The applied voltage pulses and consequential pressure pulses are set in Table I below, with columns corresponding with successive time intervals L/c.

TABLE I

| | | | | |
|---|---|---|---|---|
| Applied voltage pulse | 1 | 0 | r | 0 |
| Applied pressure pulse | +1 | −1 | +r | −r |
| Total right going pressure wave | +1 | −2 | +1 | 0 |
| Total left going pressure wave | +1 | (−1 + r) | −r | 0 |

The above applied pressure pulses applied at the beginning of each period L/c generate right and left going waves which in turn reflect from the terminations, and add further pressure waves. When the applied pressure waves and the reflected waves are added in successive periods, the magnitudes of the total right and left going waves may be obtained, and these are shown in the third and fourth rows of Table I. The cancelling voltage pulse +r in the third period is then seen to cause complete cancellation of both the right going and left going pressure waves in the fourth period. Since r is negative, the cancelling pressure pulse is opposite in sign to the initial pulse.

Moreover, in a printhead having disolaceable wall actuators, when an actuation waveform is applied to one channel to eject a drop, pressure waves are also generated in the neighbouring lines. The magnitudes of these pressure waves are not normally large enough to eject a drop. When a cancelling wave of magnitude +r is applied to the actuator channel, it is apparent that the pressure waves are also suppressed or cancelled in the neighbouring lines. When a printhead is divided into three groups a, b, c which are operated in sequence, it is the neighbouring lines in groups b or c that are next operated following operation of a channel in group a. As soon as the acoustic waves in b or c are cancelled or suppressed, and provided the ink has been replenished in the nozzles for those channels, drop ejection in these channels can be continued without delay. Evidently cancellation or suppression of residual acoustic waves in the neighbouring channels is more critical, for the successful operation of a printhead of this type, compared with cancellation in the a channels to which the pressure waveforms have been instantly applied to effect ink ejection. Meanwhile, replenishment can take place during the waveform periods available for drop ejection in the b & c channels before further actuation of the a channel.

A typical voltage waveform for drop ejection is illustrated in FIG. 5(*a*). This is a voltage waveform of the draw release type first described initially in U.S. Pat. No. 4,161,670 in connection with tubular actuators, wherein a voltage pulse is applied in the channel to be actuated first to expand the ink tube and to draw back ink in the nozzle termination and then a voltage of opposite polarity is applied causing the ink tube to contract and a pressure pulse to be generated causing ink drop ejection.

In the form of voltage waveform illustrated, the waveform includes both the draw-release waveform above and further incorporates reflected pressure wave suppression in accordance with one aspect of the present invention. This waveform consists of voltage pulses applied in successive periods corresponding to one acoustic period L/c of the channel of magnitudes −1, 1+r, 1, r(1+r) and r(1+r) where r is negative. The voltage waveform thus lasts five acoustic periods.

The applied voltage waveform may also be regarded as generating at the beginning of each successive period step voltage and pressure changes of magnitudes −1, (2+r), −r, (−1+r+r), 0, $-(r+r^2)$. This is illustrated in FIG. 5(*a*) for the value r=−0.3. The magnitudes of these pressure changes and of the resulting right going and left going pressure waves are given in Table II for variable r in general and in Table III for the particular case of r=−0.3.

TABLE II

| | | | | | | |
|---|---|---|---|---|---|---|
| Applied voltage pulse | −1 | (1 + r) | 1 | r(1 + r) | r(1 + r) | 0 |
| Applied pressure pulse | −1 | (2 + r) | −r | $(-1 + r + r^2)$ | 0 | $-(r + r^2)$ |
| Total right going pressure wave | −1 | (3 + r) | −(2 + r) | −(1 + r) | (1 + r) | 0 |
| Total left going pressure wave | −1 | 2 | $(2r + r^2)$ | −(1 + r) | $-(r + r^2)$ | 0 |

TABLE III

| r = −0.3 | | | | | | |
|---|---|---|---|---|---|---|
| Applied voltage pulse | −1 | 0.7 | 1 | −0.21 | −0.21 | 0 |
| Applied pressure pulse | −1 | 1.7 | 0.3 | −1.21 | 0 | 0.21 |
| Total right going pressure wave | −1 | 2.7 | −1.7 | −0.7 | 1.7 | 0 |
| Total left going pressure wave | −1 | 2 | −0.51 | −0.7 | 0.21 | 0 |

The magnitude of the right going pressure wave incident in the nozzle for r=−0.3 is illustrated in FIG. 5(*b*), also occupying five acoustic periods.

The corresponding pressures in the neighbouring lines, assuming that the actuator walls are comparatively rigid compared with the compliance of the ink in the channels are of opposite sign and of value approximately one half of these values. If the compliance of the actuated walls is significant compared with that of the ink then a corresponding pressure ratio between the pressure in the actuated and non-actuated channels may be calculated as a function of the compliance ratio between the actuator wall and the ink.

Figure 5A:
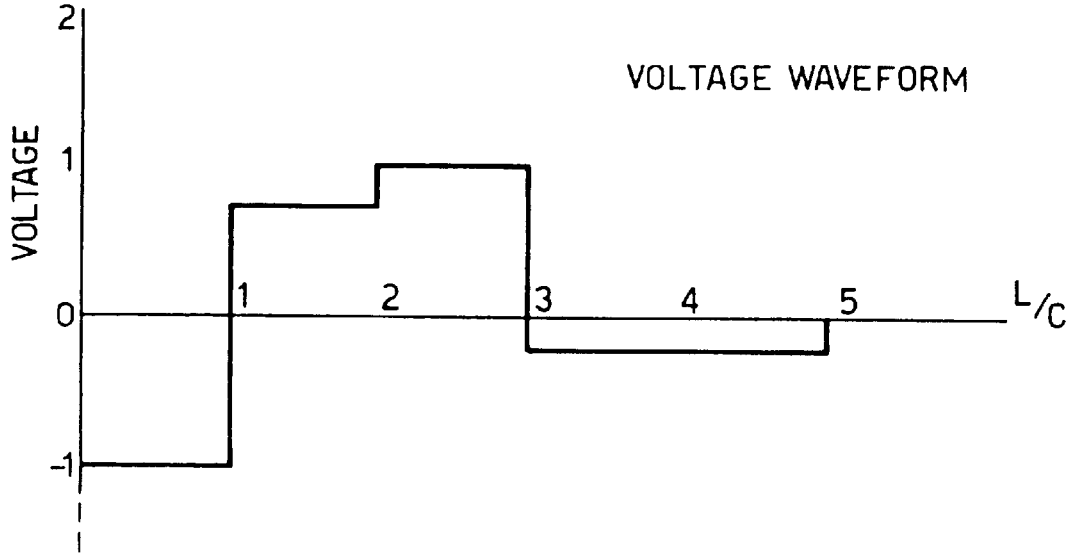
FIG. 5(*a*) illustrates one form of voltage pattern which on application to a channel generates pressure waves in the channel to eject a drop and subsequently cancels the residual pressure waves in the channel.
Figure 5B:
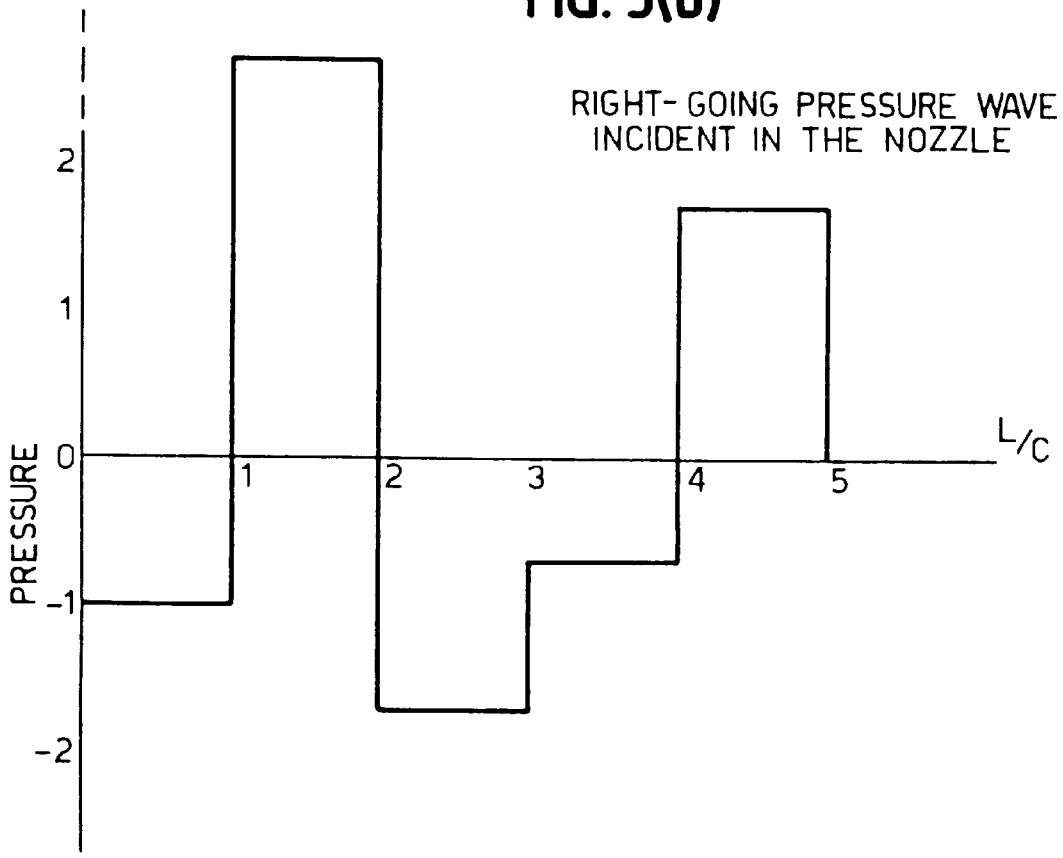
Figure 5C:
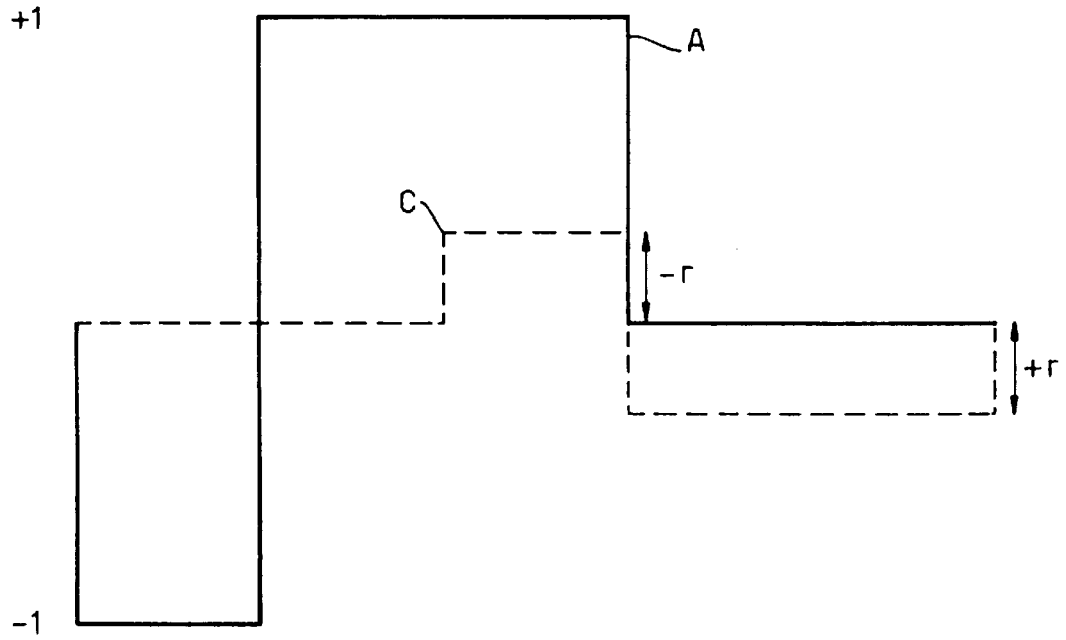

It is apparent that the waveform illustrated in FIGS. 5A–C is self cancelling. This may also be seen by resolving the wave into an actuating pulsed voltage waveform applied in successive periods L/c of magnitudes −1, 1+r, 1+r, 0,0 and a corresponding cancelling waveform obtained by adding waveforms of the same magnitude multiplied by r and delayed by Tc=2 L/c ie. of magnitudes 0, 0, $-r\ (r+r^2)$, $(r+r^2)$. This is shown in Table IV below and in FIG. 4(*c*), where the correcting waveform C is shown separately from the actuating waveform A.

TABLE IV

| | | | | | | |
|---|---|---|---|---|---|---|
| Applied voltage | −1 | (1 + r) | (1 + r) | 0 | 0 | 0 |
| Cancelling voltage | 0 | 0 | −r | $(r + r^2)$ | $(r + r^2)$ | 0 |
| Total voltage | −1 | (1 + r) | 1 | $(r + r^2)$ | $(r + r^2)$ | 0 |
| And for r = −0.3 | −1 | 0.7 | 1 | −.21 | −.21 | 0 |

It is also apparent that the magnitude of the right going pressure wave obtained by using this waveform is greater than the waveform from a simple push on voltage waveform generated by a unipolar pulse by a factor (3+r). Contrasting the third rows of Tables I and II, this corresponds to a considerable increase in the incident pressure wave at the nozzle to effect drop ejection, over a push-on impulsive pressure wave, and results in a significant reduction in the magnitude of the applied voltage.

One disadvantage of the waveform proposed in the above specification U.S. Pat. No. 4,161,670 is that it requires the application of a bipolar voltages, that is to say a voltage of one polarity followed by the application of a voltage of opposite polarity. In an ink jet printhead of the present type the drive circuit, which preferably is an integrated circuit chip, is an expensive component which can cost a significant fraction, usually more than half of the total cost of the printhead. In these circumstances it is advantageous to use a unipolar circuit so that the chip having circuits of one polarity is made with a correspondingly less number of process steps with the result that the component is obtainable at lower cost and the printhead is less expensive. It is therefore desirable to implement the above pressure waveform with a unipolar voltage waveform but at the same time to retain the pressure amplitude ratio advantage.

Unipolar operation of the printhead is described by reference to FIGS. 6(*a*) and 6(*b*), FIG. 6(*a*) illustrates the voltage waveforms applied to the printhead and FIG. 6(*b*) shows the corresponding right going pressure wave values incident in the nozzle in an ink channel 20 which is fired. Corresponding pressure waves are also generated in the neighbouring ink channels adjacent the fired line with the result that cancellation of the residual pressure waves in these lines is also effected, in order that drop ejection may take place from a neighbouring channel in the next group to be fired without delay.

Figure 6A:
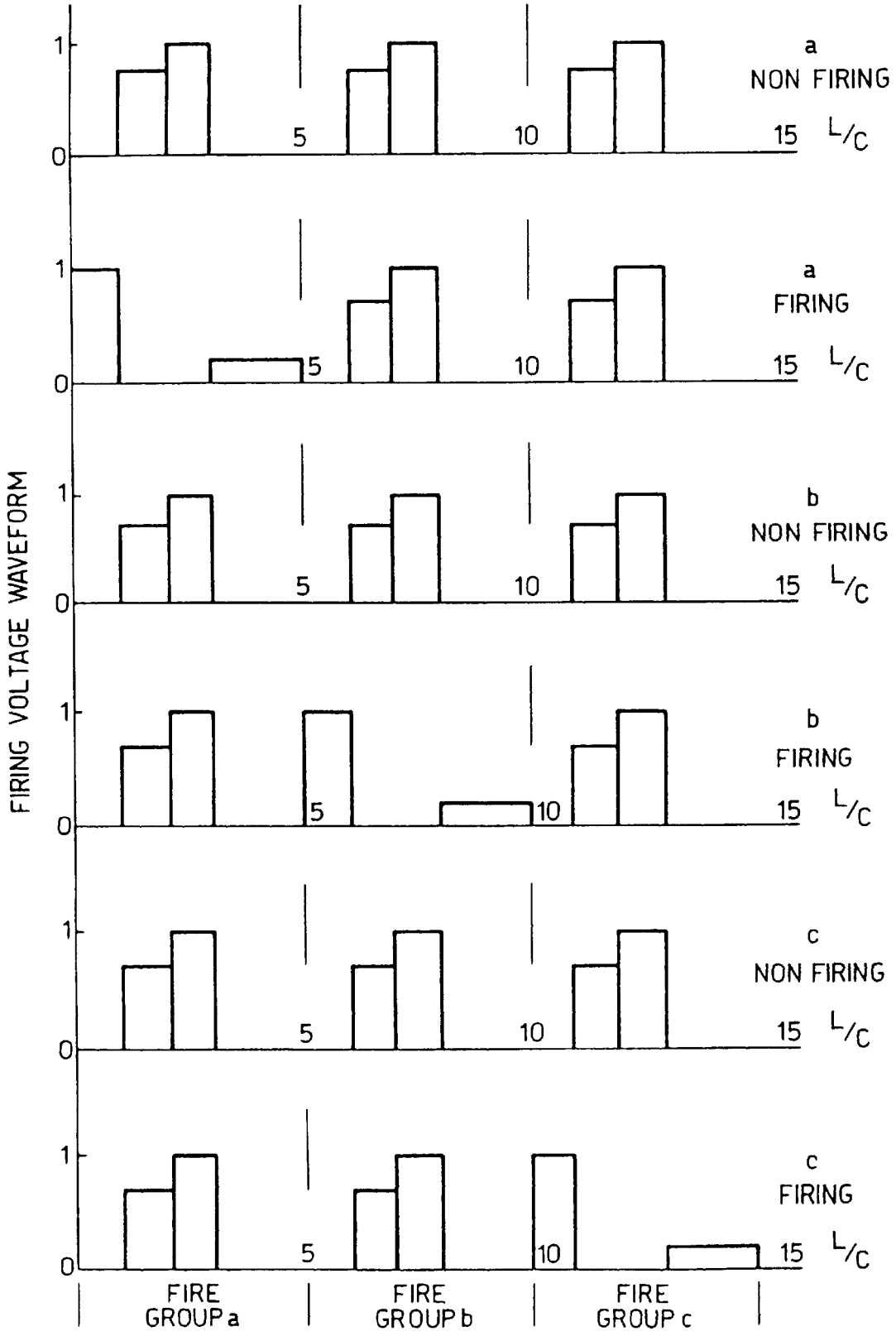
FIG. 6(*a*) illustrates one unipolar waveform in which first voltage signals are continuously applied to non firing lines and second voltage signals are applied to the lines in channels selected for firing. The waveform is self cancelling by applying cancelling pulses two periods L/c (one characteristic time Tc) following the firing pulses.
Figure 6B:
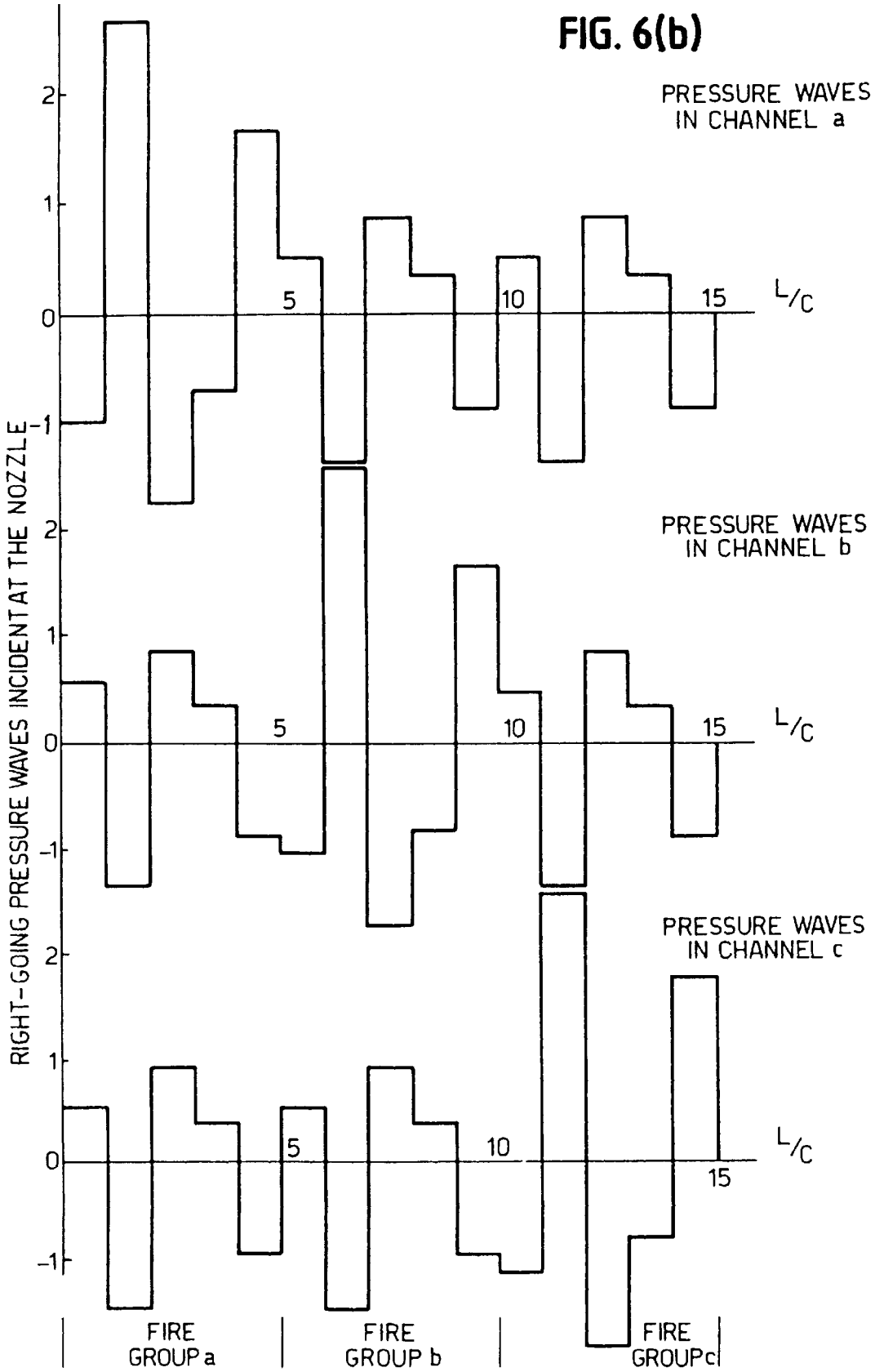

FIG. 6(*a*) illustrates the unipolar voltage waveforms applied to fired and unfired channels of groups a, b and c, these being shown in three periods a, b, c corresponding to the operation successively of channels in each group. As in FIGS. 5(*a*)–(*c*), the voltage waveform to eject a drop and to cancel the residual acoustic waves lasts a period of 5 L/c in each group, so that for three groups a, b and c the frequency of printing each line of printed dots is (15L/c). This will be seen evidently to be the maximum print speed for operation, although blank periods may be inserted in a drop-on-demand printer to reduce the rate of output for variable speed applications. By way of example if c=600 m.sec$^{-1}$ and L=4 mm the operating frequency may be 10 kHz. As already stated, this period is also usually dictated by replenishment time.

As illustrated in FIG. 6(*a*) the normal operation of the printhead, for a non-firing channel involves the application of no voltage in periods 1, 4 and 5 of the five periods of L/c when a voltage waveform is applied in each group. However, a positive voltage pulse of (1+r) and 1 is applied in periods 2 and 3 of the voltage waveform for a non-firing channel. Thus voltage excursions are applied to all lines of a printhead even when no channels are activated. However, since it is the differential voltage between channels that causes drop ejection and the same voltage is applied to all non-firing lines, no pressures are generated.

The voltage applied to fire a channel is illustrated in the period allocated for the operation of each group a, b c etc., by reference to the voltage waveform for firing channels in the corresponding period. Thus in FIG. 6(*a*) in period a under the voltage waveform to fire group a, a positive voltage of magnitude 1 is applied in the first period and a voltage r(r+1) is applied in periods 4 and 5, while the voltage magnitude in the fired lines is zero in periods 2 and 3. The voltages in the other groups b and c in the period correspond to those of neighbouring non-firing lines. The sign convention in this example is that the positive voltage applied to a channel relative to the voltage in the neighbouring lines causes the ink channel to expand.

These voltage differences on inspection are the same, (provided that the sign convention is reversed) as the voltage waveforms applied to actuate the printhead presented in FIG. 5(*a*) with the exception that the voltages applied to the channels are now unipolar. This difference is obtained by applying a continuous background voltage to the non-fired lines in periods 2 and 3 and by also applying firing signals having the same polarity in the fired lines in alternate periods 1, 4 and 5 first to effect pressure wave generation and then to cancel the residual waves in order to suppress residual meniscus oscillation. In particular immediately following the actuation of lines in any group, the residual pressure waves in the neighbouring lines are cancelled, so that the meniscus is quiescent also in those lines and drop ejection may proceed in those lines without delay.

Figure 7C:
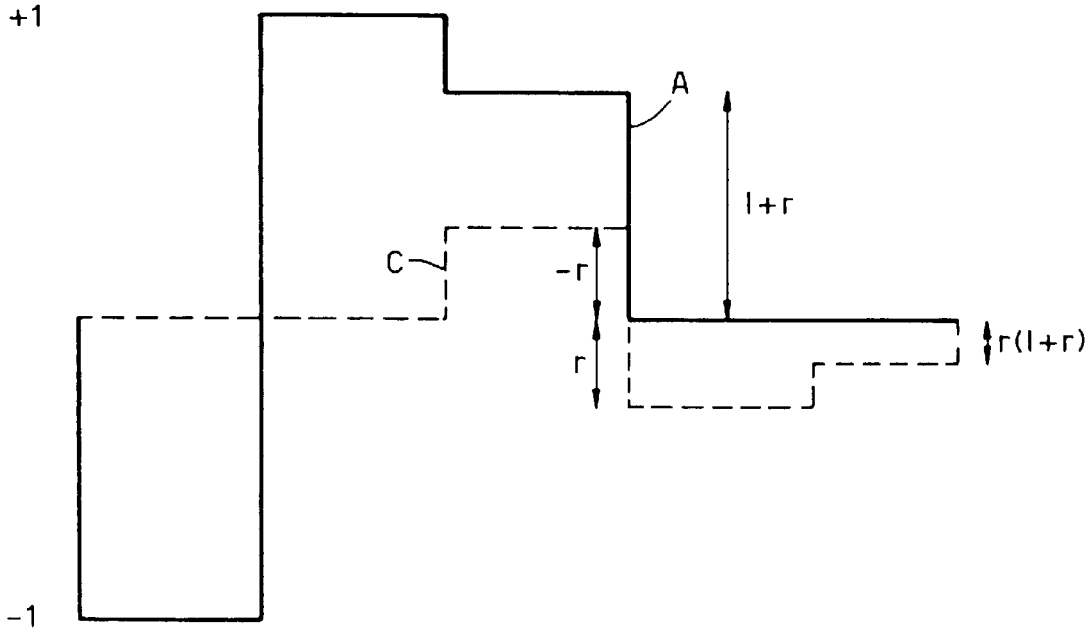
FIG. 7(*a*) shows an alternative voltage waveform that may be used in the non-fired and fired lines in place of the voltage signal used in FIG. 5(*a*)
Figure 7A:
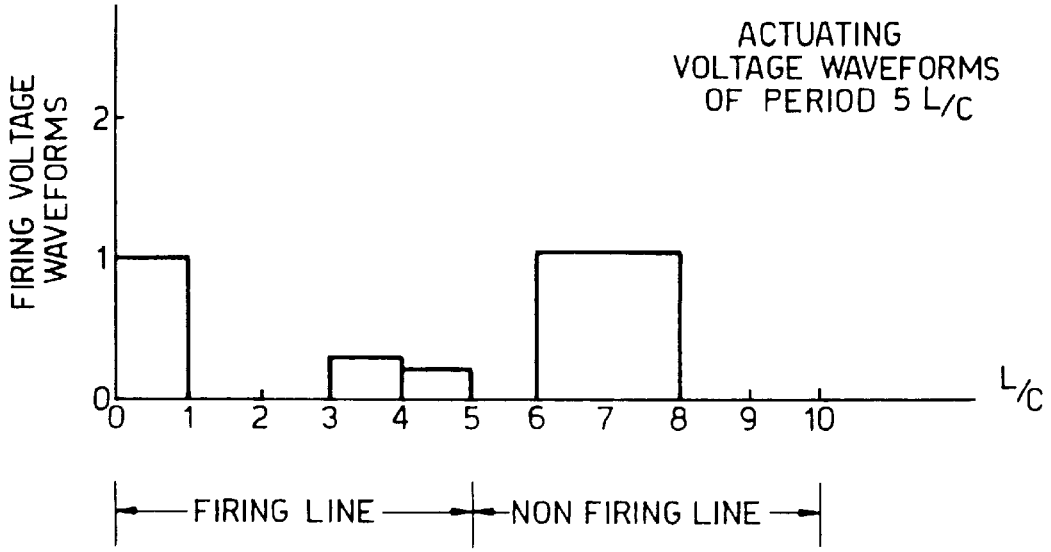
Figure 7B:
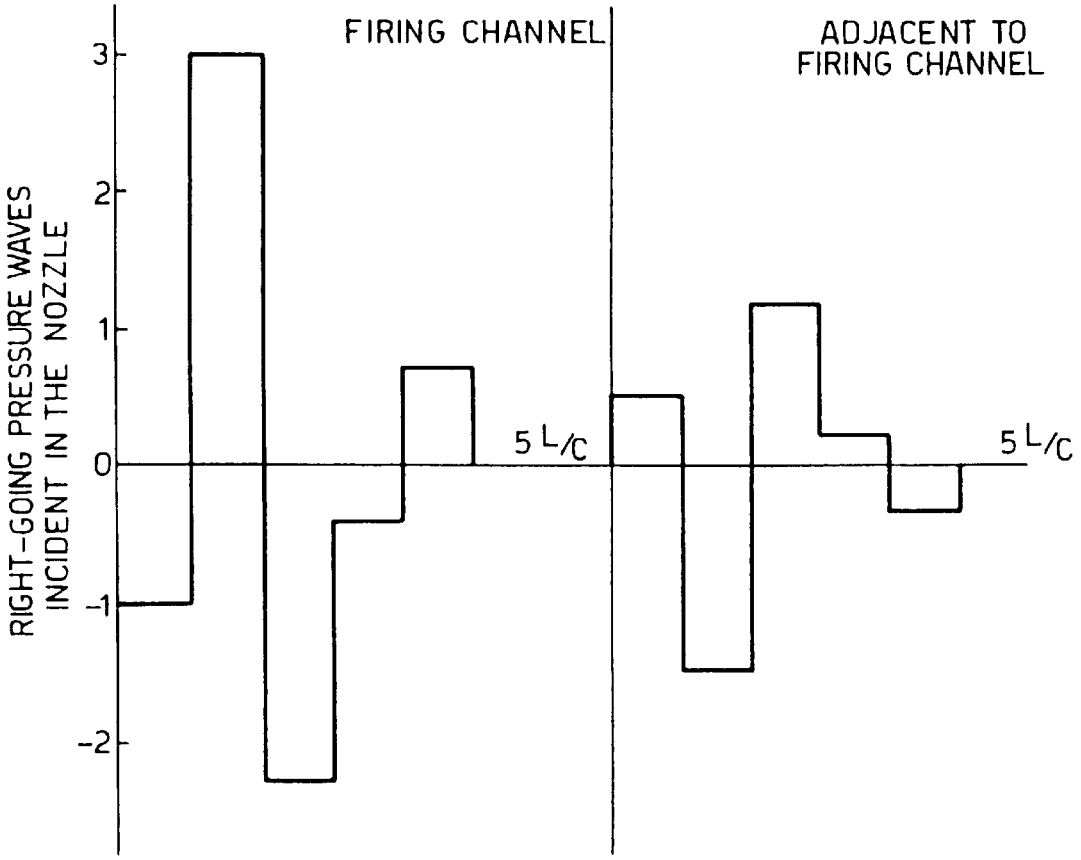

A further voltage waveform, which suppresses residual acoustic waves is illustrated in FIG. 7(*a*). This waveform also lasts a period of five acoustic periods 5L/c. The waveform shown in FIG. 7(*a*) similarly includes a waveform applied to non-firing lines and a second waveform which is applied to a fired channel in the time designated for the group corresponding to the fired channels. The voltage waveform differs in that the voltage magnitude has values 1, 1 instead of (1+r), 1 in the non-fired lines. To effect wave cancellation, the waveform in periods 4 and 5 is now r, r(1+r) instead of r(1+r), r(1+r) in the fired lines.

The effect of this modified waveform is observed by considering the pressure waveforms in FIG. 7(*b*) in which the right going pressure waves in periods 2 and 3 are now 3. −2 instead of 3+r, −2 −r; when substituting r=−0.3 this corresponds to 3, −2.3 instead of 2.7, −1.7.

It is, therefore, apparent that the ejecting pressure waveform is 10% higher and the pressure reverse at the end of the pressure pulse is −5.3 instead of −4.4, so that both drop velocity is enhanced and the pressure reversal promoting drop break-off is increased. This waveform is described in more detail in the following table:

TABLE V

| | | | | | | |
|---|---|---|---|---|---|---|
| Applied voltage pulse | −1 | 1 | 1 | r | r(1 + r) | 0 |
| Applied pressure pulse | −1 | 2 | 0 | −(1 − r) | $r^2$ | −r(1 + r) |
| Total right going pressure wave | −1 | 3 | −(2 − r) | −(1 + 2r) | 1 + r | 0 |
| Total left going pressure wave | −1 | 2 − r | 3r | $(-1 - r + r^2)$ | −r(1 + r) | 0 |

TABLE VI

| r = −0.3 | | | | | | |
|---|---|---|---|---|---|---|
| Applied voltage pulse | −1 | 1 | 1 | −0.3 | −0.21 | 0 |
| Applied pressure pulse | −1 | 2 | 0 | −1.3 | 0.09 | +0.21 |
| Total right going pressure wave | −1 | 3 | −2.3 | −0.4 | 0.7 | 0 |
| Total left going pressure wave | −1 | 2.3 | −0.9 | −0.61 | 0.21 | 0 |

It will be appreciated that the voltage difference waveform applied to the wall actuator of a selected channel again takes the form of an actuating voltage difference waveform followed after a delay 2L/c by a correcting voltage difference waveform reduced in amplitude by the factor −0.3. This is shown in FIG. 6(*c*).

Figure 8A:
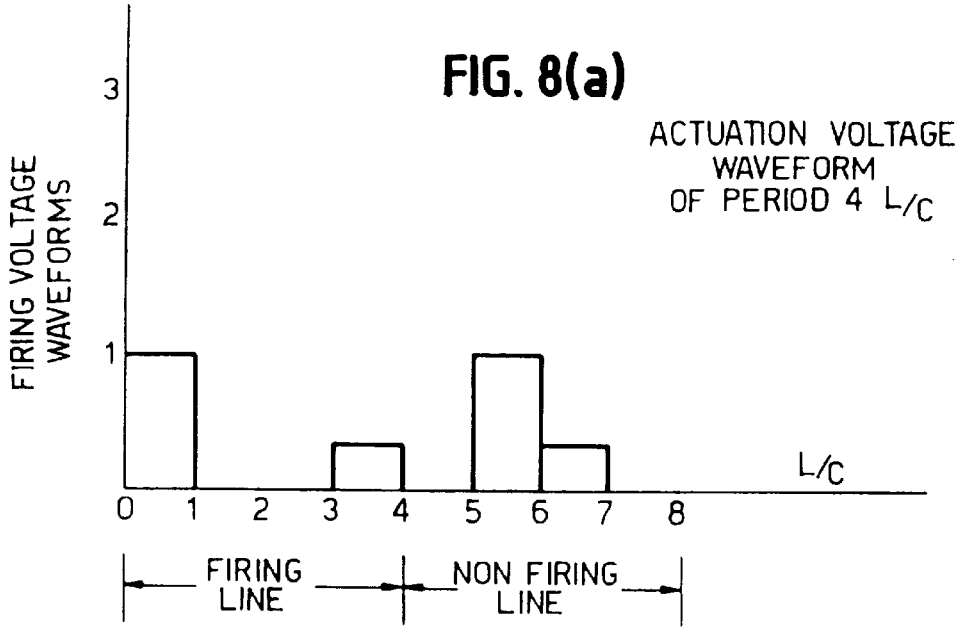
FIG. 8(*a*) shows a further alternative voltage waveform that may be used in the non-fired and fired lines in place of the voltage signals above.
Figure 8B:
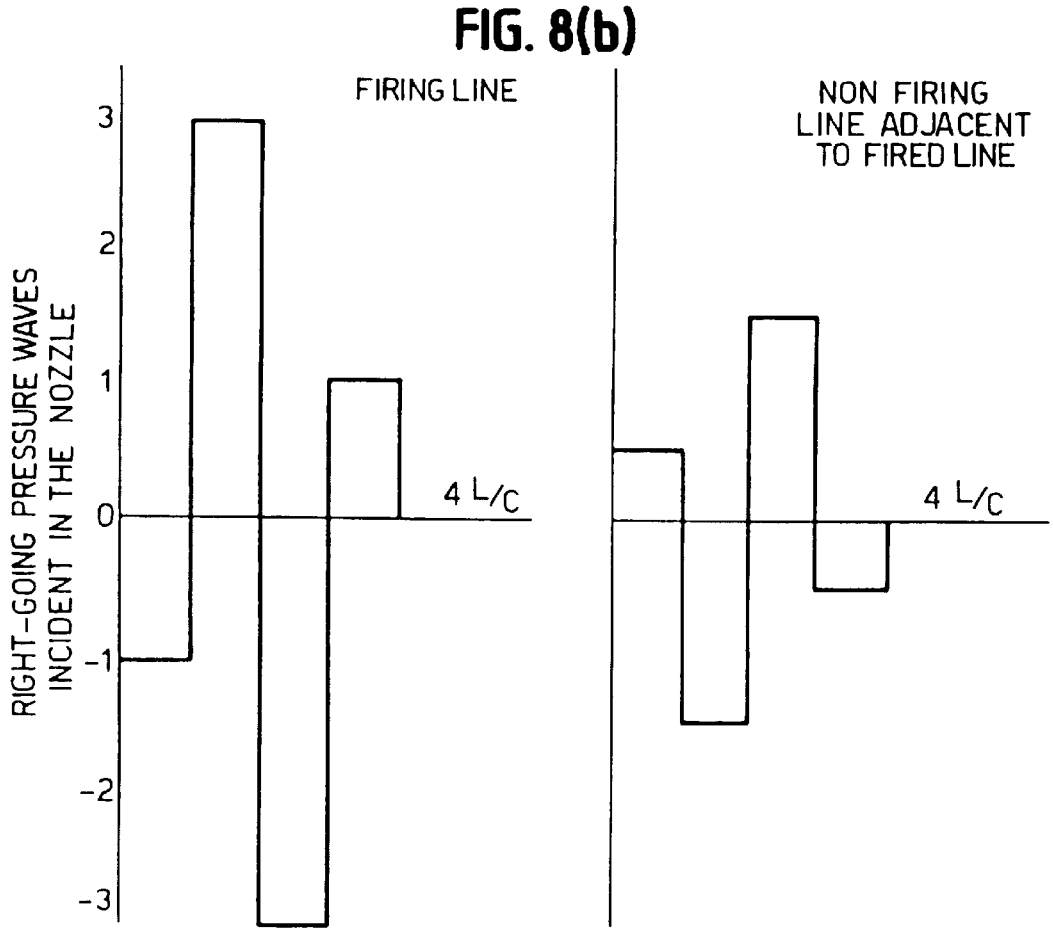

A further form of unipolar voltage waveform is illustrated in FIGS. 8(*a*and 8(*b*). This waveform lasts 4 periods of L/c in each group, so that the frequency of operation may be increased to c/12L, which is 20% faster. In addition it has pressure waves 3,−3 in periods 2 and 3, so that the pressure reversal in this case is now −6 instead of −4.4 in the waveform of FIGS. 6(*a*) and 6(*b*).

This waveform may be further understood by reference to the following table:

TABLE VII

| | | | | | |
|---|---|---|---|---|---|
| Applied voltage pulse | −1 | 1 | −r | r | 0 |
| Applied pressure pulse | −1 | 2 | −(1 + r) | 2r | −r |
| Total right going pressure wave | −1 | 3 | −3 | 1 | 0 |
| Total left going pressure wave | −1 | 2 − r | −(1 − 2r) | −r | 0 |

Again, FIG. 8(*a*) shows the unipolar voltages applied to the fired channel and adjacent non-fired channel whilst FIG. 8(*b*) shows the right going pressure waves, that is to say the pressure waves incident upon the nozzle. In the above FIGS. 5(*a*)–(*c*), 6(*a*) and 6(*b*), 7(*a*)–(*c*), 8(*a*), and 8(*b*) and the corresponding Tables, voltage pulses are presented which first develop energetic pressure waves to effect drop ejection and then cancel or suppress the residual pressure wave energy. The voltages and corresponding right and left going magnitudes are presented in simplified form in terms of a constant nozzle refection coefficient.

In practice the nozzle reflection coefficient is not exactly constant. Although broadly constant when the ink meniscus is external to the nozzle it falls progressively in magnitude to more negative values when the ink meniscus retracts into the nozzle, and in particular takes lower values following drop ejection. Therefore although the above voltage waveforms provide clear guidance to the timing and magnitudes of voltage pulses to effect cancellation, and may in appropriate circumstances be usable directly. The values used may also be measured or verified experimentally.

Consider for example a printhead arranged in three groups a, b and c actuated in succession with waveforms of duration five periods L/c such as those illustrated in FIGS. 6(*a*) and 6(*b*) and 7(*a*)–(*c*). Observation of the drop ejection could be carried out by depositing ink drops on paper and measuring the accuracy of dot landing. Alternatively and preferably drop ejection can be observed stroboscopically under a microscope. One test is to observe the motion of the meniscus in the nozzles of group b after completion of a waveform applied to group a. For complete cancellation the meniscus should remain quiescent after completion of the waveform. A second test is to measure the velocity of ink drops ejected from group b both when preceded and when not preceded by drop ejection from an earlier fired adjacent group a. A velocity difference is an indication of incomplete cancellation.

Certain findings of experimentation with regard to cancellation are presented below by reference to FIGS. 9, 10, and 11. When cancellation is determined experimentally, on the premise that estimates of reflection coefficient from the nozzle are unreliable, it is the effect of variation in the magnitudes of the voltage pulses in the last two periods of the waveform that is obtained. Also is the average value of the voltage pulse magnitudes that govern cancellation, so that pulse shape does not confer any significant effect on drop velocity.

In the absence of cancellation pulses in the last two periods of a waveform (such as applied to group a), a drop ejection signal in response to a subsequent waveform (applied to the adjacent group b) generally results in drop ejection at reduced velocity. This is more particularly the case for the four period waveform described by reference to FIGS. 8(*a*) and 8(*b*).

Drop ejection velocity from the succeeding group (such as group b) is then increased by application of either a+ve pressure applied to the next-to-last pulse or a−ve pressure pulse applied to the last pulse period. There are accordingly a range of pulse magnitudes of the combined pulses in the two periods that create a pressure signal of the phase appropriate to effect correction or cancellation of the drop velocity variation. Of these combinations, there is one that also effects cancellation in the alternate pressure wave phase. However it is generally not deleterious but is sometimes useful to leave some energy in the alternate phase to modify performance of the printhead in some other respect.

Figure 9:
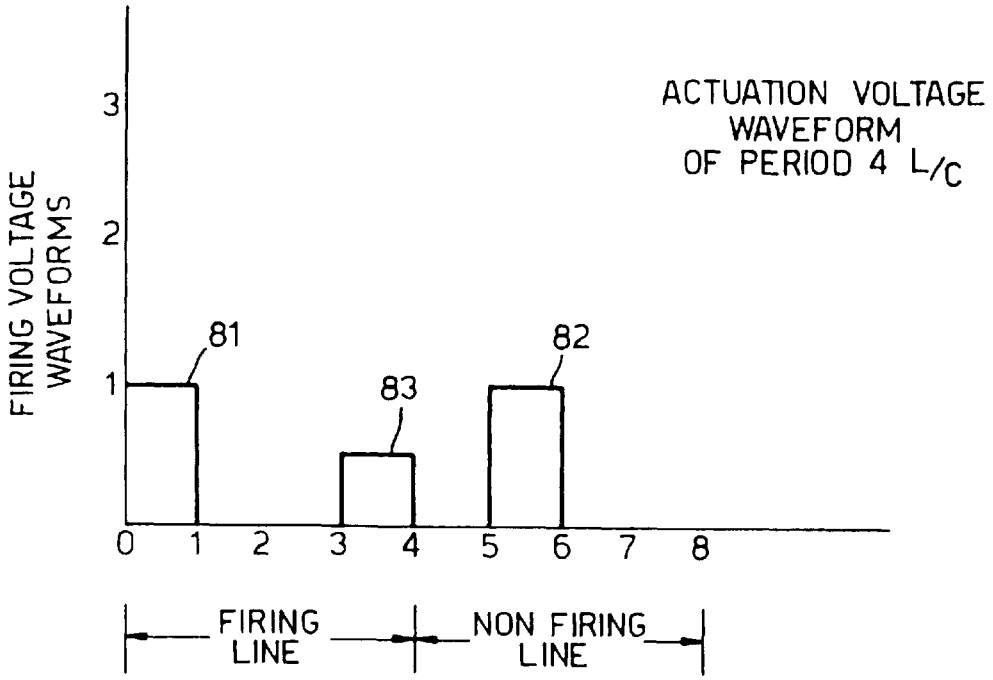
FIGS. 9 and 10 show still further alternative voltage waveforms that may be used in the non-fired and fired lines in place of the voltage signals of FIG. 8(*a*)

FIG. 9 shows a firing waveform in firing lines, that may be compared to the voltage waveform in FIG. 8(*a*). Each waveform has a total period of 4L/c. The firing line voltage has an initial pulse 81 that withdraws ink into the nozzle. The following firing pulse 82 is then applied to the non-fired lines in the active croup and to all the lines in the inactive group in period two. In this respect the waveform of FIG. 9 follows the waveform in 8(*a*). A cancelling pulse 83 is also applied in period four of the fired lines, whose magnitude is derived experimentally (by normalising the velocity of drops in the succeeding group). This pulse has a value somewhat greater than the corresponding pulse magnitude in FIG. 8(*a*) due to the absence in FIG. 9 of a cancelling pulse in period three of the non-fired lines. Such a pulse 83 may always be found to effect cancellation of the residual pressure wave contribution to drop velocity in the succeeding phrase.

Experience shows that a waveform such as that in FIG. 9 tends Lo have a lower voltage threshold for the production of accidental drops produced during the withdrawal period of the succeeding group from the non-fired lines of that group. Often this is not a restriction for printheads producing small drops at high frequency.

Figure 10:
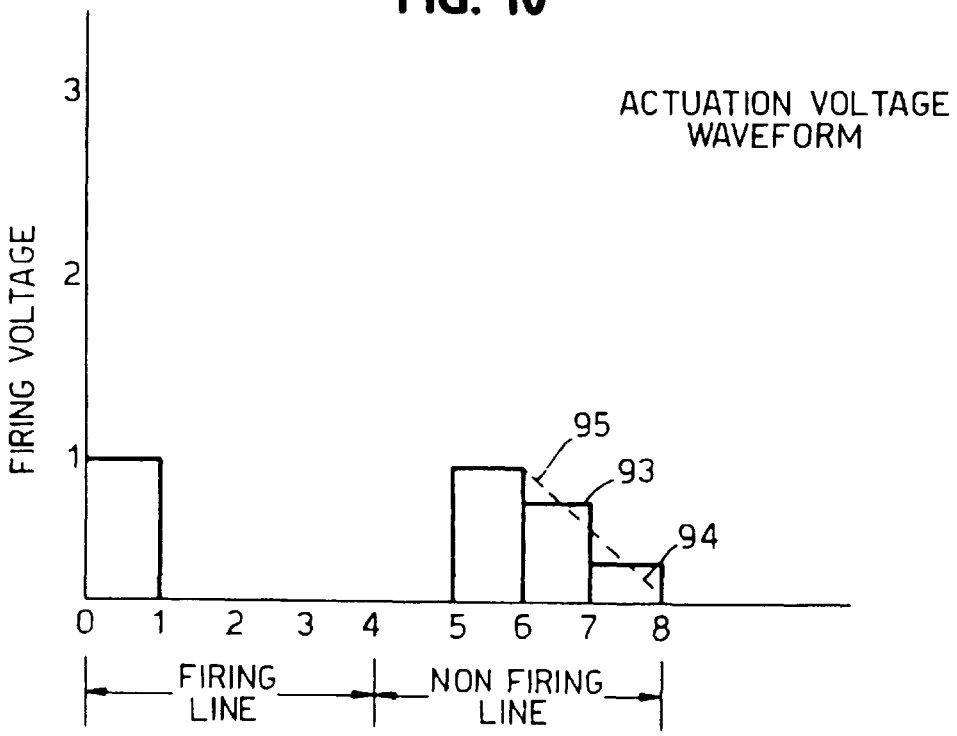

FIG. 10 illustrates the other extreme where the cancellation pulse 93 in period three of the non-fired lines is present to a greater degree than employed in FIG. 8(*a*). In the extreme its magnitude can be made so great that the pulse contribution 94 in period four, instead of compromising a positive pulse in the fired lines, becomes negative so that instead the pulse is applied to the non-fired lines. A typical combination of pulses 93 and 94 in the third and fourth pulse periods in the non-fired lines is illustrated in FIG. 10. The pulse magnitudes are determined experimentally by observing the drop velocity in the succeeding group and restoring its value to normal.

The waveform in FIG. 10 illustrates the alternative extreme to that in FIG. 9, since the latter has no cancellation pulse and the former maximum cancellation pulse in period three, while the cancellation pulse in period four in each case is chosen empirically to effect drop velocity control in the succeeding group. The waveform in FIG. 10 is particularly useful for printheads which develop drops of large volume and at high velocity (typically above 10 $m.sec^{-1}$), in which the tendency to eject accidental drops from non-fired lines is increased, and where the waveform of FIG. 10 corrects such a tendency.

The dotted line in FIG. 10 illustrates that a rectangular pulse for such cancellation pulses is not essential and that a sloped wave form 95 can sometimes be identified which effects cancellation.

Figure 11:
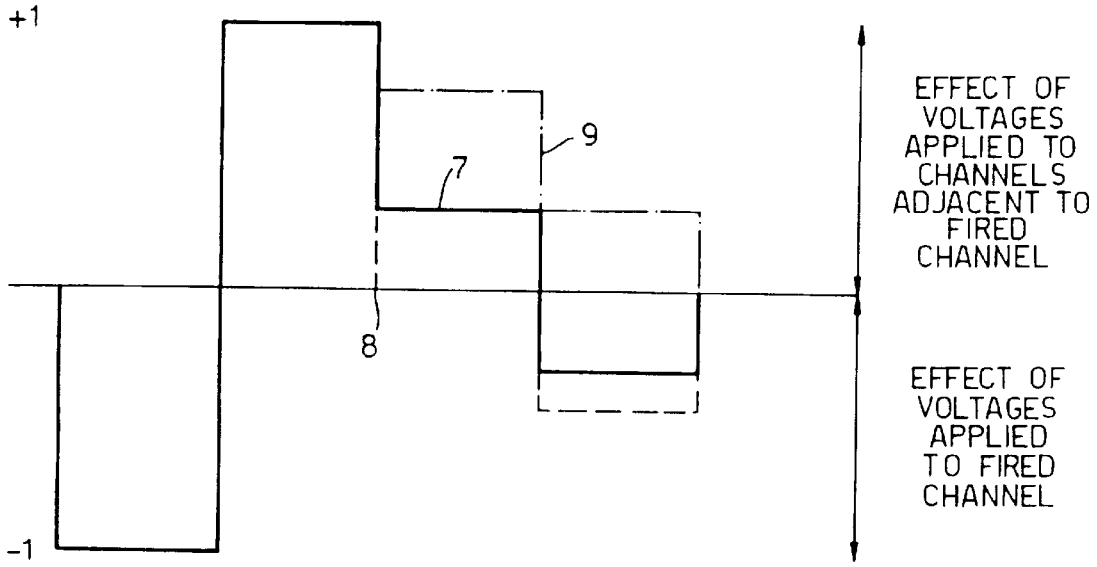
FIG. 11 is a diagram on which are superimposed for comparison purposes, the voltage difference signals arising from application to the fired and non-fired lines of the waveforms shown in FIG. 8(*a*), FIG. 9 and FIG. 10, respectively.
Figure 12:
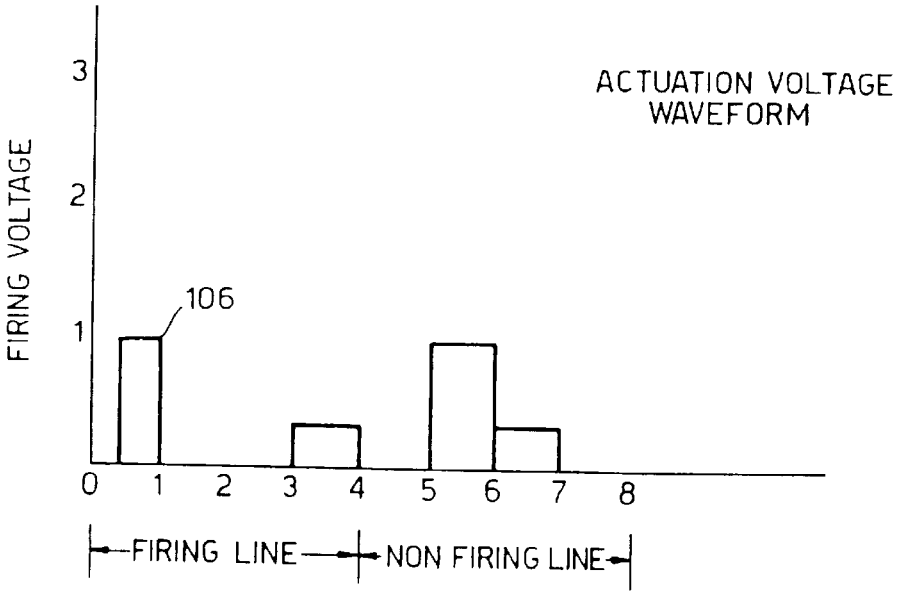
FIG. 12 is a diagram similar to FIG. 8(*a*) illustrating a further modification to the invention.

To show more clearly the contrasts between the arrangements to FIGS. 8(*a*) and 8(*b*), 9, and 10 superimposed voltage difference waveforms correspond respectively with the unipolar arrangements of FIGS. 8(*a*) and 8(*b*), 9, and 10 as shown in FIG. 11.

Experience has also shown that the general level of the velocity of drop ejection when several adjacent lines in a group are selected for firing is greater than the drop velocity of end lines of a group, or of a single isolated line in the group. Such a drop velocity variation may become visible as printed dot landing errors.

A method of correction found to be effective to allow for velocity variation due to a print pattern or print density variation is to vary the pulse width of the initial withdrawal pulse in the fired lines as shown in FIG. 11 by reference to 106. Pulse width 106 is narrowed when a higher density of line neighbours are selected and is restored to its normalised width when a single line without near neighbours is fired.

It will, therefore, be evident that a number of different actuation waveforms may be selected to achieve different performance on criteria required for different applications of the printhead.

The above voltage waveforms may readily be implemented in a unipolar electronic chip connected to each channel of the ink jet printhead.

Each feature disclosed in this specification (which term includes the claims) and/or shown in the drawings may be incorporated in the invention independently of any other such feature.

What is claimed is:

1. A method of operating multichannel pulsed droplet deposition apparatus having droplet liquid channels each with a nozzle having a pressure wave reflection coefficient r where r is negative, each channel having a negative pressure wave reflection coefficient at a termination connected to means for supplying droplet liquid, the method comprising the step of ejecting a droplet from a selected channel by generating therein defined pressure changes comprising a negative pressure pulse of duration L/c followed by a positive pressure pulse of duration at least L/c and substantially canceling residual pressure waves in said channel by generating further pressure changes opposed to said defined pressure changes after a delay of 2L/c where L is the length of the channel and c is the effective velocity of pressure waves in the channel.

2. A method according to claim 1, comprising the step of relating the amplitude of said further pressure changes to the amplitude of said defined pressure changes by the factor r.

3. A method according to claim 1, comprising the step of generating a positive pressure pulse of duration 2L/c.

4. A method according to claim 3, comprising the step of generating a first further pressure pulse with a delay of 2L/c after the negative pressure pulse and generating a second further pressure pulse with a delay of 2L/c after the positive pressure pulse.

5. A method according to claim 1, wherein said droplet liquid channels of said multichannel pulsed droplet deposition apparatus are bounded by displaceable wall actuators, said apparatus having selected channels and non-selected channels arranged in respective groups of channels which are actuated sequentially with each said selected channel being bounded by a displaceable wall actuator, said actuator also bounding said adjacent non-selected channel, and wherein displacement of said wall actuator generates said defined and further pressure changes, the displacement of the actuator also generating complementary defined pressure changes in the adjacent non-selected channel and complementary further pressure changes in said adjacent non-selected channel which cancels further residual pressure waves in said adjacent channel arising from said complementary defined pressure pulse.

6. A method according to claim 5, comprising the step of dividing the channels into at least two groups, the groups being sequentially enabled for actuation, adjacent channels being in different groups.

7. A method according to claim 1 wherein said droplet deposition apparatus has droplet liquid channels separated by wall actuators displaceable on the application to the wall actuators of a voltage difference, each said channel having at least one electrode associated with wall actuators bounding that channel such that a voltage difference can be applied to a specified wall actuator by the application of different voltages to respective electrodes of the two channels separated by the said wall actuator, the method comprising the step of actuating a selected channel through the steps of applying in different time periods a first actuating voltage to an electrode of the selected channel and a second actuating voltage of the same polarity to an electrode of non-selected channels, thereby causing expansion and contraction of the droplet liquid volume of the selected channel to generate said defined pressure changes.

8. A method according to claim 7, wherein there is applied to one or more electrodes a correcting voltage comprising a first correcting voltage delayed by 2L/c with respect to said first actuating voltage applied to the electrodes of non-selected channels and a second correcting voltage delayed by 2L/c with respect to said second actuating voltage applied to an electrode of the selected channel, where L is the length of the channel and c is the effective velocity of pressure waves of the channel.

9. A method according to claim 8, comprising the step of relating the magnitude of said first correcting voltage to the magnitude of said first actuating voltage by a factor less than 1 and relating the magnitude of said second correcting voltage to the magnitude of said second actuating voltage by a factor less than 1.

10. A method according to claim 9, comprising the steps of relating the magnitude of said first correcting voltage to the magnitude of said first actuating voltage and relating the magnitude of said second correcting voltage to the magnitude of said second correcting voltage by equal factors less than 1.

11. A method according to claim 7, the method comprising the steps of applying a first voltage of relative magnitude 1 to an electrode of the selected channel in a first time period L/c, a second voltage of relative magnitude 1 to the electrodes of non-selected channels in a second time period L/c, a third voltage of relative magnitude between 0 and 1+r to the electrodes of non-selected channels in a third time period L/c, and a fourth voltage of relative magnitude between 0 and 1+r to the electrodes of either the selected channels or non-selected channels in a fourth time period L/c, where the fourth voltage is not zero if the third voltage is zero.

12. A method according to claim 11, wherein the relative magnitude of the third voltage is equal to r and wherein the fourth voltage is of relative magnitude r and the method comprises the step of applying said fourth voltage to an electrode of the selected channel.

13. A driving circuit for a multichannel pulsed droplet apparatus, said apparatus having droplet liquid channels of length L, having an effective velocity c of pressure waves in the channels, with a droplet ejection nozzle having a pressure wave reflection coefficient r, the driving circuit comprising means for actuating the apparatus according to claim 1.

* * * * *